US007025440B2

(12) United States Patent
Graf et al.

(10) Patent No.: US 7,025,440 B2
(45) Date of Patent: Apr. 11, 2006

(54) LOW PROFILE INK JET CARTRIDGE ASSEMBLY

(75) Inventors: Paul William Graf, Lexington, KY (US); John Richard Fowler, Nicholasville, KY (US); Kristi Maggard Rowe, Richmond, KY (US); Timothy Lorn Howard, Lexington, KY (US); Matthew Joe Russell, Stamping Ground, KY (US); Paul Timothy Spivey, Lexington, KY (US); Frank Edward Anderson, Sadieville, KY (US)

(73) Assignee: Lexmark International, Inc., Lexington, KY (US)

( * ) Notice: Subject to any disclaimer, the term of this patent is extended or adjusted under 35 U.S.C. 154(b) by 274 days.

(21) Appl. No.: 10/686,245

(22) Filed: Oct. 15, 2003

(65) Prior Publication Data

US 2005/0083374 A1 Apr. 21, 2005

(51) Int. Cl.
*B41J 2/14* (2006.01)

(52) U.S. Cl. ..... 347/50; 347/86

(58) Field of Classification Search ..... 347/50, 347/86

See application file for complete search history.

(56) References Cited

U.S. PATENT DOCUMENTS

| | | | | |
|---|---|---|---|---|
| 4,635,080 | A | 1/1987 | Watanabe | |
| 4,755,836 | A | 7/1988 | Ta et al. | |
| 4,872,026 | A | 10/1989 | Rasmussen et al. | |
| 4,907,018 | A | 3/1990 | Pinkerpell et al. | |
| 4,940,413 | A | 7/1990 | Childers et al. | |
| 5,212,502 | A | 5/1993 | Bowling | |
| 5,467,116 | A | 11/1995 | Nakamura et al. | |
| 5,533,904 | A | 7/1996 | Nobel et al. | |
| 5,538,436 | A | 7/1996 | Garney | |
| 5,598,194 | A | 1/1997 | Hall et al. | |
| 5,612,511 | A | 3/1997 | Meyer et al. | |
| 5,623,293 | A | 4/1997 | Aoki | |
| 5,706,040 | A * | 1/1998 | Reid et al. | 347/50 |
| 5,796,417 | A | 8/1998 | Nobel | |
| 5,835,111 | A | 11/1998 | Balazer | |
| 5,861,901 | A | 1/1999 | Kashimura et al. | |
| 5,953,028 | A | 9/1999 | Nobel et al. | |

(Continued)

FOREIGN PATENT DOCUMENTS

| | | |
|---|---|---|
| EP | 0547596 | 6/1993 |
| EP | 0581298 | 2/1994 |
| EP | 1095780 | 5/2001 |
| JP | 60204333 | 10/1985 |

*Primary Examiner*—David M. Gray
*Assistant Examiner*—Jannelle M. Lebron
(74) *Attorney, Agent, or Firm*—Luedeka, Neely & Graham P.C.

(57) ABSTRACT

A low-profile ink jet cartridge assembly for an ink jet printer. The low profile ink jet cartridge assembly includes a substantially rectangular ink jet cartridge body having a printhead side, opposing side surfaces attached to the printhead side and a length, a height, and a width, wherein the length is greater than the height and the width. A printhead containing a semiconductor substrate is attached to the printhead side of the ink cartridge. A flexible circuit having a width, a length, a first edge along the length thereof, a second edge along the length thereof, first printer contact pads along at least a portion of the length thereof adjacent the first edge, and second printer contact pads along at least a portion of the length thereof adjacent the second edge is attached to the ink cartridge on the opposing side surfaces of the cartridge body.

11 Claims, 8 Drawing Sheets

U.S. PATENT DOCUMENTS 5,988,804 A 11/1999 Kotaki et al.
6,007,184 A 12/1999 Terasawa et al.
6,053,598 A 4/2000 Inpyn
6,070,965 A 6/2000 Fujimoto
6,074,042 A 6/2000 Gasvoda et al.
6,137,508 A 10/2000 Gaarder

* cited by examiner

LOW PROFILE INK JET CARTRIDGE ASSEMBLY

FIELD OF THE INVENTION

The invention relates to improved ink jet printhead assemblies and in particular to printhead assemblies having electrical contacts disposed on opposing side portions of a cartridge body.

BACKGROUND

Ink jet technology continues to be improved in order to increase printing speed and print quality or resolution. One means for improving print speed and quality is to increase the number of nozzle holes in an ink jet printhead and to decrease the diameter of the nozzle holes. An increase in the number of nozzle holes also increases a corresponding number of heater resistors on the printhead chip. With an increase in the number of heater resistors, there is also an increase in the number of conductors, circuit connections, and electrical contacts required for operating the printhead. A larger number of circuit connections to a chip often requires a larger chip surface area to make the connections. Accordingly, the number of conductors, circuit connections, and electrical contacts for operating a printhead determine the length and width of a flexible circuit used to make electrical connections between the printer and the printhead chip.

Conventional ink cartridge designs make it difficult to increase the number of heater resistors and flexible circuit size without also increasing the width and height of the ink cartridge. The size of the flexible circuit establishes the minimum height and width of the cartridge body since the flexible circuit is attached to the cartridge. The ink cartridge height and width is an important factor in the design and physical size of the printer in which it is used. As the size of the ink cartridge increases, so also does the size and footprint of the printer thereby increasing printer cost and ability of consumers to use the printers in a variety of locations.

There is a need therefore for improved ink jet cartridges which enable space-saving and cost-saving printer designs.

SUMMARY OF THE INVENTION

With regard to the foregoing and other objects and advantages, the invention provides a low-profile ink jet cartridge assembly for an ink jet printer. The low profile ink jet cartridge assembly includes a substantially oblong ink jet cartridge body having a printhead side, opposing side surfaces attached to the printhead side and a length, a height, and a width, wherein the length is greater than the height and the width. A printhead containing a semiconductor substrate is attached to the printhead side of the ink cartridge. A flexible circuit having a width, a length, a first edge along the length thereof, a second edge along the length thereof, first printer contact pads along at least a portion of the length thereof adjacent the first edge, and second printer contact pads along at least a portion of the length thereof adjacent the second edge is electrically connected to the printhead. The portions of the flexible circuit containing the first and second contact pads are attached to the cartridge body on the opposing side surfaces of the cartridge body.

In another embodiment, the invention provides a method for increasing a number of electrical contacts to an ink cartridge without significantly increasing a height dimension of the ink cartridge. The method includes providing a substantially rectangular ink jet cartridge body having a printhead side, opposing side surfaces attached to the printhead side and having a length, a height, and a width, wherein the length is greater than the height and the width. A printhead containing a semiconductor substrate is attached to the printhead side of the ink cartridge. A flexible circuit having a width, a length, a first edge along the length thereof, a second edge along the length thereof, first printer contact pads along at least a portion of the length thereof adjacent the first edge, and second printer contact pads along at least a portion of the length thereof adjacent the second edge, the first and second printer contact pads comprising a total number of electrical contacts is provided. The flexible circuit is connected in electrical communication with the printhead. The portions of the flexible circuit containing the first and second contact pads are attached to the opposing side surfaces of the cartridge body, wherein the total number of electrical contacts on the cartridge body is increased without significantly increasing the height of the cartridge body.

The invention provides a number of advantages over conventional ink jet printhead cartridge assemblies. For one, an ink cartridge having a reduced height is provided even for a printhead having an increased number of ink ejectors. The reduced height ink cartridge enables use of a printer having a smaller footprint. For purposes of this invention, an ink cartridge having a reduced height is referred to as a "low profile" ink cartridge. A "low profile" ink cartridge preferably has an overall length dimension greater than an overall height dimension thereof.

Another advantage of the invention is that the ink cartridge may be inserted in a carriage in the printer by a single insertion motion. This motion simplifies alignment of the cartridge in the carriage and also provides a wiping motion for the electrical contacts thereby removing surface contaminants that may be present on the contacts.

BRIEF DESCRIPTION OF THE DRAWINGS

The above and other aspects and advantages of the invention will become further apparent by reference to the following detailed description of preferred embodiments when considered in conjunction with the accompanying drawings in which.

DETAILED DESCRIPTION OF THE PREFERRED EMBODIMENTS

Figure 1:
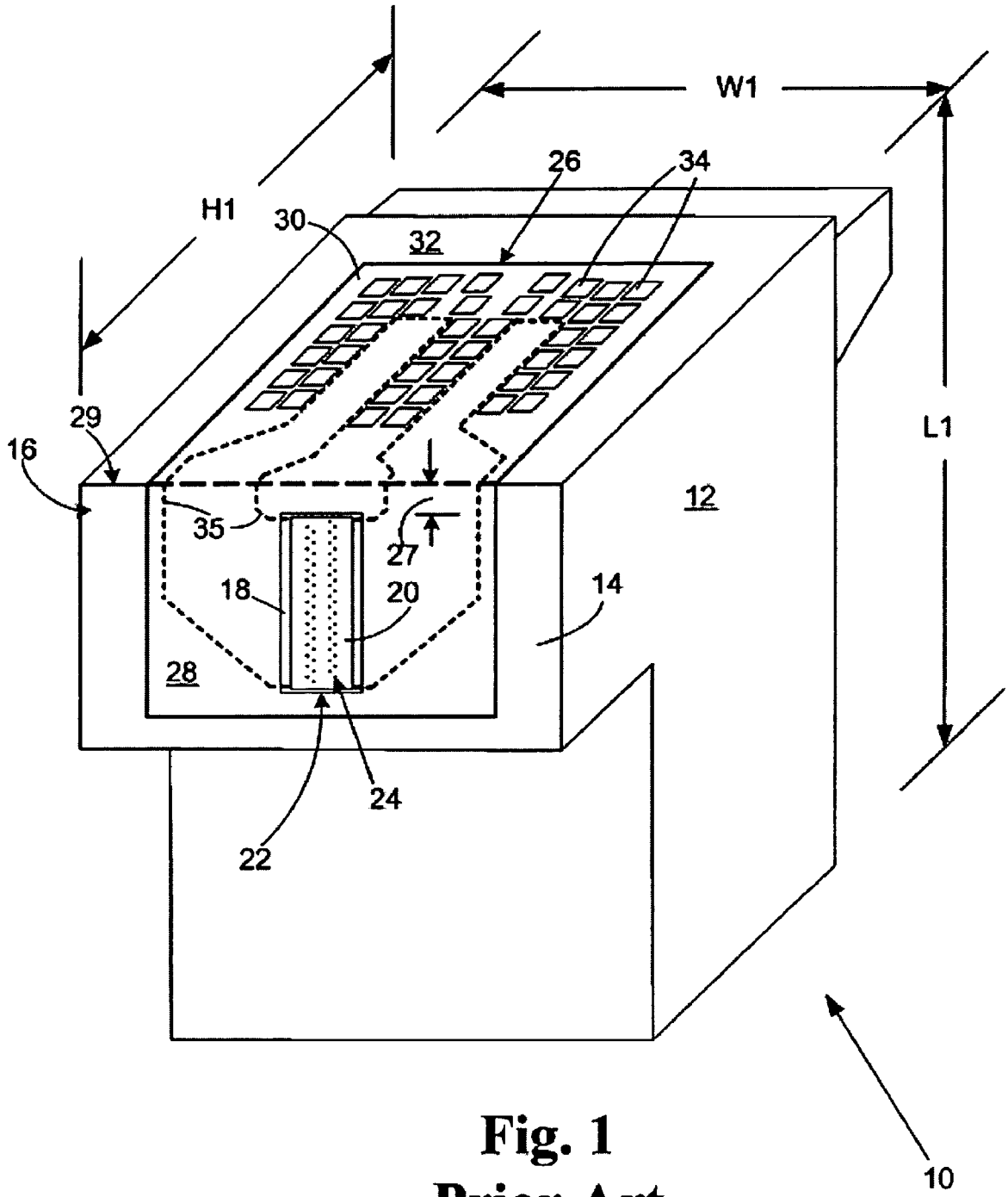
Fig. 1 Prior Art
FIG. 1 is a perspective view, not to scale, of a conventional ink cartridge.

A conventional ink jet cartridge 10 is shown in perspective view in FIG. 1. The ink cartridge 10 includes a cartridge body 12 having a printhead surface 14 on one end 16 thereof. The printhead surface 14 has attached to it a printhead 18, including a semiconductor substrate 22 and a nozzle plate 20 attached to the semiconductor substrate 22. The semiconductor substrate 22 contains ink ejection devices such as heater resistors or piezoelectric devices that operate to eject ink through nozzle holes 24 in the nozzle plate 20.

Figure 2:
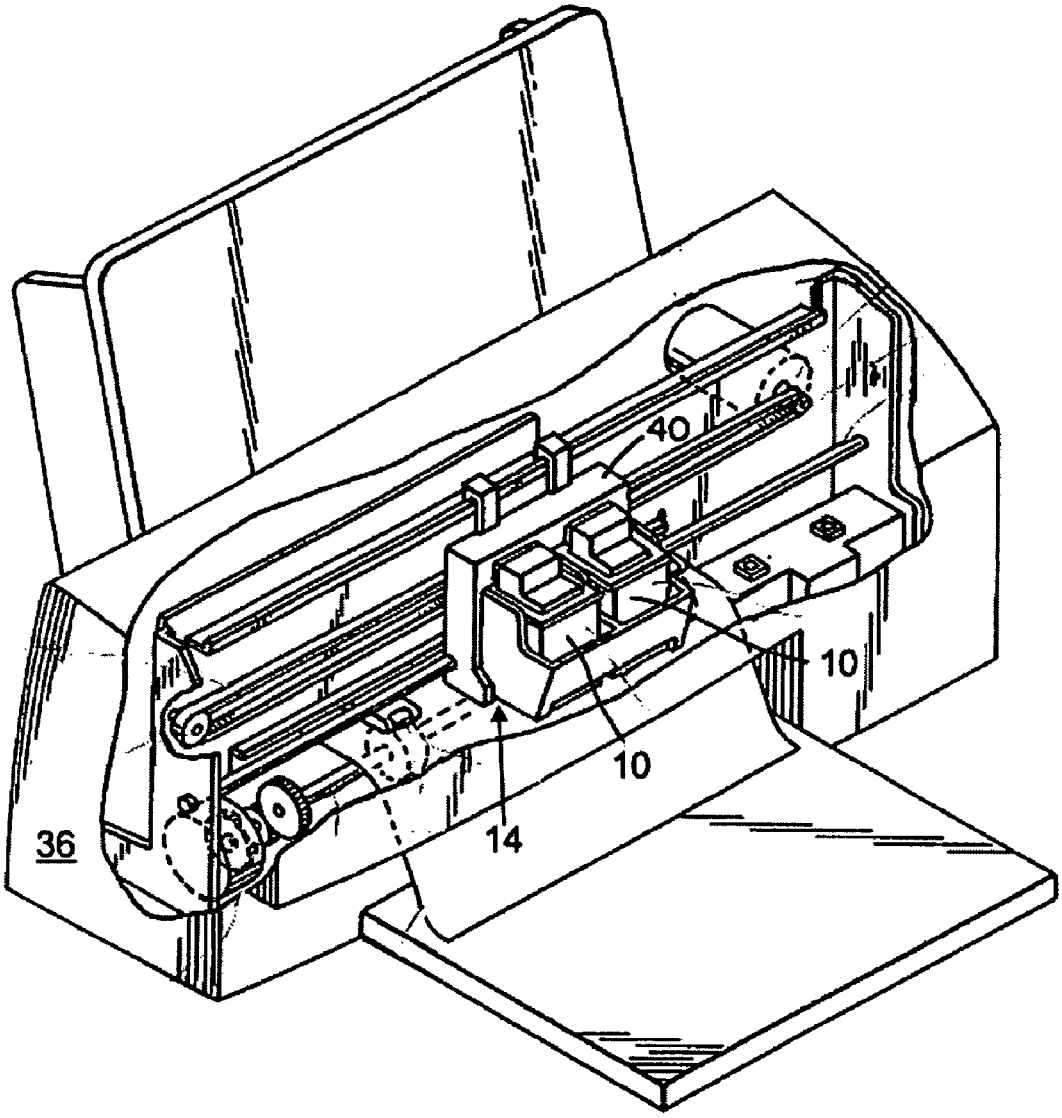
Fig. 2 Prior Art
FIG. 2 is a perspective view, not to scale, of an ink jet printer using a conventional ink cartridge.

In order to provide electrical impulses to the ink ejection devices on the semiconductor substrate 22, a flexible circuit 26 is attached to the semiconductor substrate 22. The flexible circuit includes a first end 28 attached to the printhead 18 on the printhead surface 14 of the ink cartridge 10 and a second end 30 attached to a side surface 32 of the ink cartridge 10. Contact pads 34 are provided on the second end 30 of the flexible circuit for making electrical contact with a printer 36 when the ink cartridge 10 is installed in the printer 36 as shown in FIG. 2. As shown, the flexible circuit 26 for a conventional ink cartridge 10 is bent around edge 29 of the ink cartridge body 12 to provide an electrical contact pad area for contact pads 34.

The flexible circuit 26 generally has a natural 90 degree bend radius of 1 millimeter due to its composition and thickness. Due to this bend radius, a distance 27 is required between the printhead 18 and an edge 29 of the ink cartridge body 12 in order to minimize stress between the flexible circuit 26 and the electrical connections attached to the semiconductor substrate 22. Also, the distance 27 between the printhead 18 and the edge 29 of the cartridge body 12 is critical to obtaining proper print media registration as rollers feeding print media through a printer are positioned near the edge 29 of the cartridge body 12. Thus the ability to print near the edge of a print media is determined by the distance 27 between the printhead 18 and edge 29 of the cartridge body 12.

Other factors which determine the size of the flexible circuit 26 are the area required for a number and size of contact pads 34 and for the number and width of electrical traces 35 connected between the contact pads 34 and the semiconductor substrate 22. The width of the electrical traces 35 and the spacing between adjacent electrical traces 35 affects the electrical performance of the traces and also has an effect on the width of the flexible circuit 26 needed for containing the electrical traces 35 and spacing between the traces 35. Small width electrical traces 35 introduce unwanted energy losses into the system.

Figure 3:
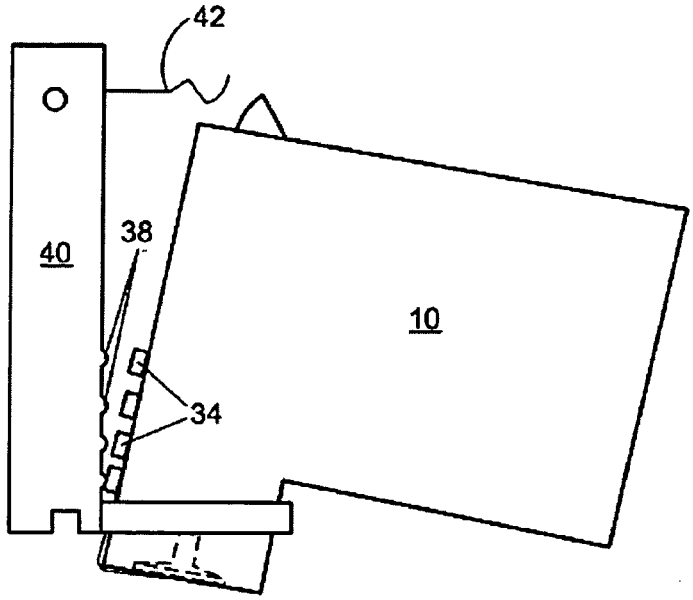
Fig. 3 Prior Art
FIGS. 3 and 4 are schematic representations of inserting a conventional cartridge into an ink jet printer carriage.

The size of the flexible circuit 26 and area needed for attaching the flexible circuit 26 to the cartridge body 12 are factors in determining the size of ink cartridge body 12 to which it is attached. In the conventional ink cartridge shown in FIG. 1, all of the contact pads 34 are disposed on side surface 32 of the ink cartridge body 12 so that the contact pads 34 align with electrical contacts 38 on a printhead carriage 40 (FIG. 3). Printhead carriage 40 is operable to translate the ink cartridge 10 across the width of a print media during a printing operation. In order to accommodate the flexible circuit 26 having size constraints as described above, the conventional ink cartridge 10 has a height (H1), a length (L1) and a width (W1) as shown in FIG. 1. Typical conventional ink cartridges 10 have a height ranging from about 40 millimeters to about 80 millimeters, a length ranging from about 40 millimeters to about 60 millimeters, and a width ranging from about 28 millimeters to about 36 millimeters.

Figure 4:
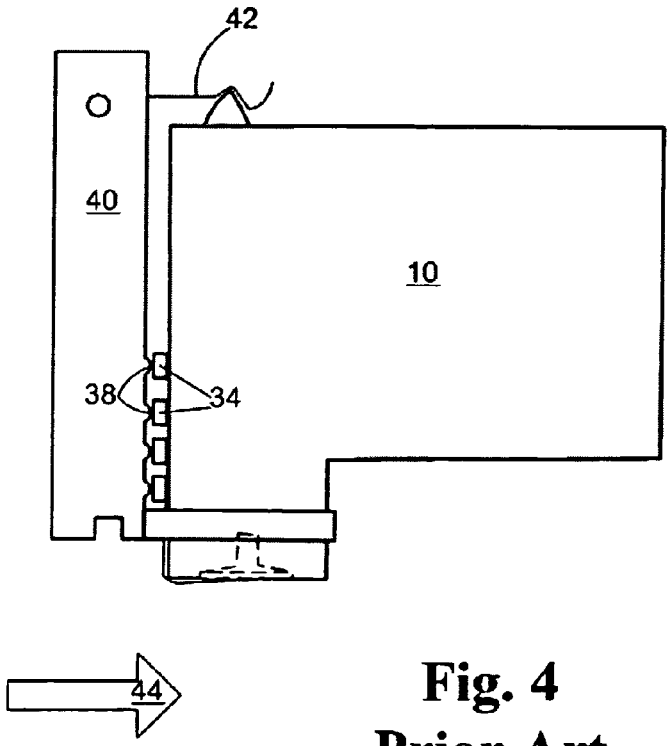
Fig. 4 Prior Art

A detailed schematic view of a conventional ink jet cartridge 10 being attached to a carriage 40 is shown in FIGS. 3 and 4. For a conventional ink jet cartridge 10, the flexible circuit 26 and contact pads are on a side surface 32 thereof so that the ink cartridge 10 is attached to the carriage 40 by slanting the ink cartridge 10 as the cartridge is inserted into the carriage 40 as shown in FIG. 3. The cartridge 10 is then rotated into a locked position on the carriage 40 so that the contact pads 34 are adjacent and in contact with electrical contacts 38 on the carriage 40. A latching device 42 is provided to maintain the cartridge 10 in a predetermined position on the carriage 40. It will be appreciated that the carriage 40 provides a force on the cartridge 10 in the direction of arrow 44. This force must also be sufficient to puncture contaminants on the surface of the contact pads 34 and/or electrical contacts 38 so that suitable electrical contact is made between the ink cartridge 10 and the printer.

From the foregoing description it is evident that in order to increase the number of contact pads 34 on the flexible circuit 26 without adversely affecting the electrical characteristics of the circuit, both the length and width of the flexible circuit 26 will have to be increased. Since the electrical circuit 26 is only attached to two adjacent side surface of the cartridge body 12, the height (H1) and width (W1) of the cartridge body 12 will have to be increased to accommodate the larger flexible circuit 26. A larger cartridge body 12 requires a larger sized printer 36 to accommodate the larger cartridge body 12. In contrast, the invention enables an increase in the number of contact pads on the flexible circuit without significantly increasing the height or width dimension of the cartridge body as described in more detail below.

Figure 5:
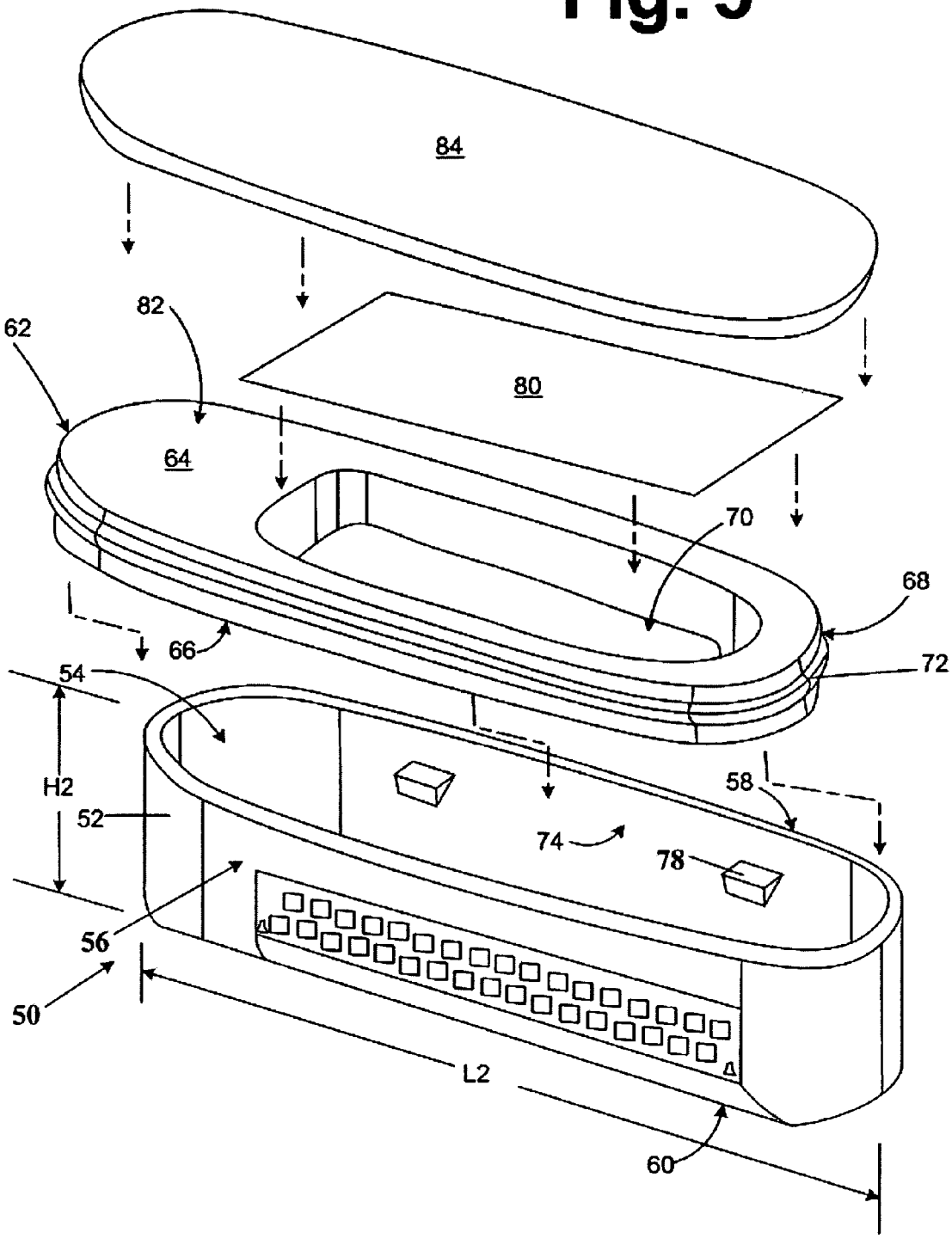
FIG. 5 is an exploded, perspective view, not to scale, of a low profile ink cartridge according to the invention.

FIG. 5 is a perspective exploded view, not to scale of a low profile ink jet cartridge assembly 50 according to the invention. The low profile ink jet cartridge assembly 50 includes a substantially rectangular ink jet cartridge body 52 having an open top cavity 54 defined by opposing side walls 56 and 58 attached to a printhead side 60 defining the cavity 54. The body 52 also has a length (L2), a width (W2) (FIG. 11), and a height (H2) associated therewith. However, the height (H2) of the ink cartridge 50 according to the invention is preferably less than the height (H1) of the conventional ink cartridge 10. In a particularly preferred embodiment, the height (H2) of the ink cartridge 50 according to the invention ranges from about 10 millimeters to about 30 millimeters. The width (W2) of the ink cartridge 50 preferably ranges from about 12 millimeters to about 16 millimeters. The length (L2) of the ink cartridge 50 preferably ranges from about 30 millimeters to about 40 millimeters.

The ink cartridge body 52 component of the cartridge assembly 50 is preferably made of a first material selected from metals, plastics, glass, ceramics, and composites of two or more of the foregoing. More preferably the ink cartridge body 52 is molded from a material selected from the group consisting of thermoplastic materials including but not limited to polyphenylene oxide/polystyrene alloys, polypropylene, acrylonitrile/butadiene/styrene terpolymers, polystyrene/butadiene alloys or copolymers, polyetherimide, polysulfone, polyesters and the like. A particularly preferred material for cartridge body 52 is a polyphenylene ether/polystyrene resin available from GE Plastics of Pittsfield, Mass. under the trade name NORYL SE1701.

The cartridge assembly 50 includes a pressure control structure 62 for providing a controlled ink pressure to a printhead attached to the printhead side 60. The pressure control structure 62 has a first surface 64 and a second surface 66 opposite the first surface and a side surface 68 around the periphery thereof. An aperture 70 extends through the pressure control structure 62 from the first surface 64 to the second surface 66 thereof. The pressure control structure 62 is preferably made of a polymeric material, preferably a thermoplastic material selected from polypropylene and polyethylene materials. The most preferred material is polyethylene material having a melting point of about 120° C.

A sealing structure 72 is provided on side surface 68 for forming a liquid tight and air tight seal between an inner surface 74 of opposing side walls 56 and 58 and the side surface 68 of the pressure control structure 62. The sealing structure 72 preferably provides the liquid tight and air tight seal by purely mechanical means. Accordingly the sealing structure 72 may be selected from elastomeric materials and adhesives. A particularly preferred sealing structure 72 is an elastomeric o-ring made from ethylene propylene diene monomer (EPDM). Regardless of whether the sealing structure 72 is an adhesive or elastomeric o-ring material, it is preferred that the sealing structure 72 be substantially chemically resistant to the components of ink used in the printhead assembly 10.

Figure 6:
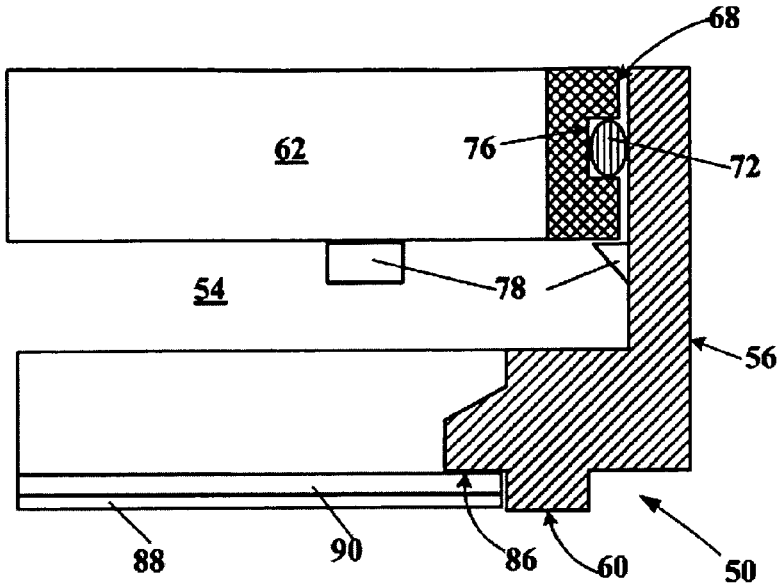
FIG. 6 is a partial cross-sectional view, not to scale, of a low profile ink cartridge according to the invention.

As shown in more detail in FIG. 6, the pressure control structure 62 preferably includes a peripheral groove 76 in the side surface 68 thereof. The groove 76 is preferably dimensioned to accept an o-ring or bead of adhesive as the sealing structure 72. In order to improve assembly between the pressure control structure 62 and the cartridge body 52, stops 78 or a ledge may be provided to limit the distance the pressure control structure 62 can be moved into the cavity 54.

A flexible film 80 is preferably melt attached to the pressure control structure 62 to control pressure in the cavity 54. The film 80 is preferably attached to close or otherwise cover the aperture 70 in the pressure control structure 62. The film 80 may be made from a wide variety of materials including, but not limited to, films that are compatible with the inks used in the ink printhead assembly 50 and films adaptable to welding or adhesive attachment thereof to a first surface 82 of the pressure control structure 62. Such films 80 include polyethylene films and polypropylene films having a thickness ranging from about 1.5 to about 3 mils.

A particularly preferred film 80 for controlling pressure in the assembly 50 is a copolymer polypropylene material available from Triangle Plastics of Raleigh, N.C. under the trade name CPP40. The copolymer polypropylene material may be laminated with an adhesive available from Minnesota Mining and Manufacturing Company of Minneapolis, Minn. under the trade name 3M-845. It is preferred however, to use a non-laminated film 80 that is capable of being heat welded to the first surface 82 of the pressure control structure 62. Heat welding of the film 80 to the surface 82 may be accomplished by providing a pressure control structure 62 made from a polymeric material having a similar melting point to that of the film 80 or having a lower melting point than the melting point of the film 80. In a particularly preferred embodiment, the film 80 is preferably selected from a material having substantially the same melting point as that of the material of the pressure control structure 62.

A cover 84 is preferably attached to the ink cartridge body 52 to protect the film 80 from damage and to provide additional sealing between the cavity 54 and the pressure control structure 62. The cover 84 may be heat welded, adhesively attached or snap fit to the ink cartridge body 52.

Figure 7:
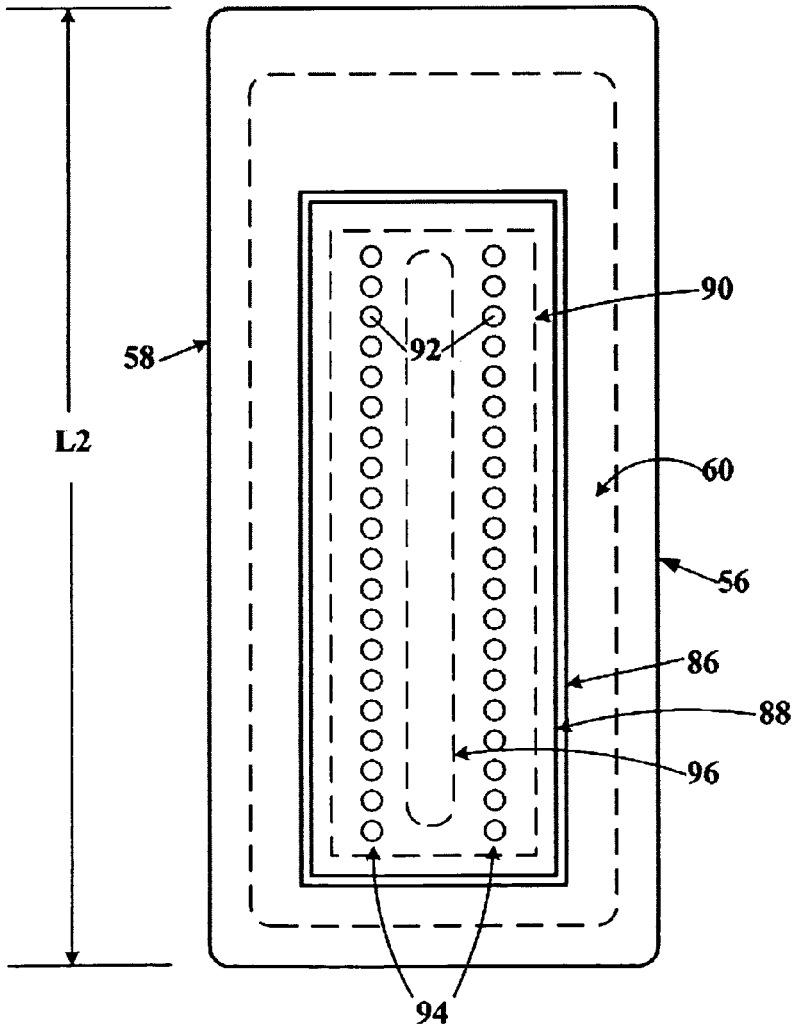
FIG. 7 is a plan view, not to scale, of a printhead side of an ink cartridge according to the invention.

With reference to FIGS. 6 and 7, printhead side 60 of the ink cartridge body 52 preferably includes a pocket or recessed area 86 for attaching a nozzle plate 88 and semiconductor chip 90 thereto. The nozzle plate 88 preferably includes a plurality of nozzle holes 92 for ejection of ink therethrough toward a print media. The nozzle holes 92 may be provide in one or more arrays 94 along the length of the nozzle plate 88. An ink feed via 96 in the chip 90 provides a flow of ink to ink ejectors on the chip 90. The ink ejectors may be selected from thermal or electromechanical type ejectors including heater resistors and piezoelectric devices.

The cavity 54 of the ink cartridge assembly 50 may be filled with ink before or after attaching the film 80 to the pressure control structure 62. In the sequence wherein ink is inserted into the cavity before attaching the film 80 to the pressure control structure, the pressure control structure 62 is first inserted into the cavity 54. If the film is first attached to the pressure control structure 62 before the pressure control structure is inserted into cavity 54, then the ink is inserted into the cavity 54 before inserting the pressure control structure 62 into cavity 54.

After the cavity 54 is filled with ink, the pressure control structure 62 is inserted into the cavity 54, and the cover 84 is attached to the cartridge body 52, a reduced pressure or back pressure is applied to the cavity 54, preferably through an opening in the ink cartridge body 52, to provide a predetermined pressure differential between cavity 54 and the nozzle plate/chip assembly 88/90. As ink is ejected through the nozzle holes 92, the volume of ink in the cavity 54 decreases. The pressure regulator structure 62 and film 80 are effective to maintain a predetermined pressure in cavity 54 as the volume of ink in the cavity 54 decreases. The pressure regulator structure 62 and film 80 also help to compensate for pressure changes in ink cavity 54 due to ambient temperature and pressure changes. In most instances, the predetermined minimum pressure or back pressure maintained in the cavity 54 ranges from about −80 to about −240 millimeters (mm) of water.

A biasing device such as a coil spring, leaf spring, resilient foam or the like is preferably included in the cavity 54 to bias the film 80 away from the printhead side 60 of the cartridge body 52 in order to maintain a predetermined pressure on ink in the cavity 54. In an alternative embodiment, the biasing device may be disposed between the cover 84 and the film 80 to bias the film 80 toward the printhead side 60 of the cartridge body 52 in order to maintain a predetermined pressure in the cavity 54.

Figure 8:
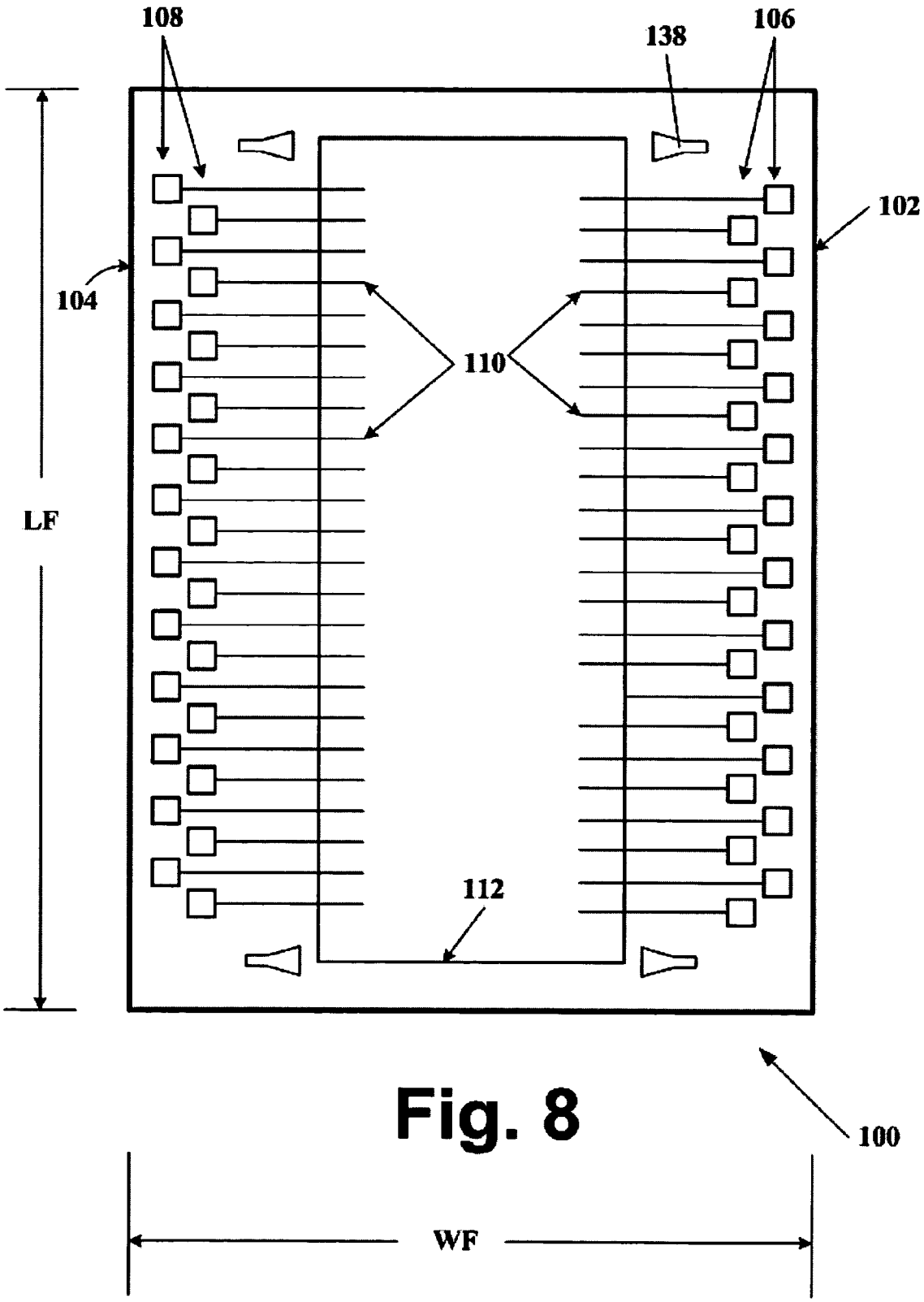
FIG. 8 is a plan view, not to scale, of a flexible circuit for an ink cartridge according to the invention.
Figure 9:
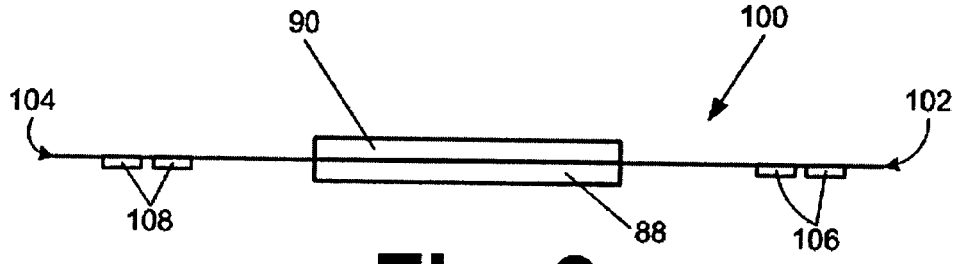
FIG. 9 is a side elevational view, not to scale, of a flexible circuit attached to a printhead according to the invention.

An important feature of the invention is a flexible circuit structure 100 shown in FIGS. 8–9. The flexible circuit structure 100 has a width (WF), a length (LF), first and second edges 102 and 104 along the length (LF) thereof. First printer contact pads 106 are provided along at least a portion of the length (LF) adjacent the first edge 102 thereof. Second printer contact pads 108 are provided along at least a portion of the length (LF) adjacent the second edge 104 thereof. Electrical traces 110 are provided on the flexible circuit 100 for providing connection to the semiconductor chip 90 through a window 112 in the flexible circuit 100. A side elevational view, not to scale, of the flexible circuit 100 attached to a semiconductor chip 90 and nozzle plate 88 is shown in FIG. 9.

Figure 10:
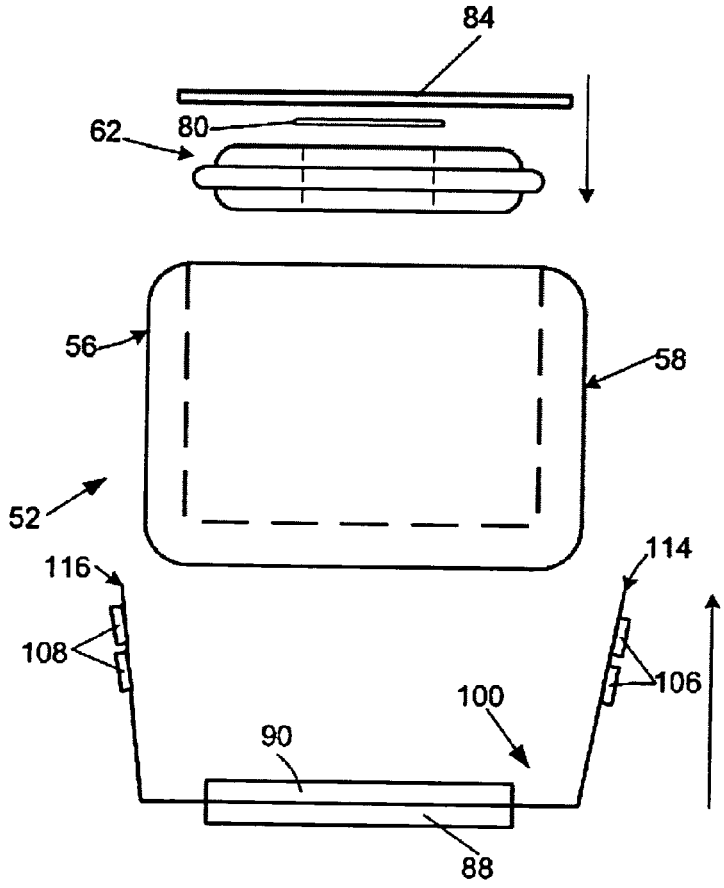
FIG. 10 is exploded elevational view, not to scale, of a low profile ink cartridge and flexible circuit according to the invention.

During the assembly process for the ink cartridge 50, the flexible circuit 100 is folded as shown in FIG. 10 so that wing portions 114 and 116 can be applied to the opposed sides 56 and 58 of the ink cartridge body 52. The wing portions 114 and 116 are preferably adhesively attached to the opposed sides 56 and 58 of the ink cartridge body 52.

Figure 11:
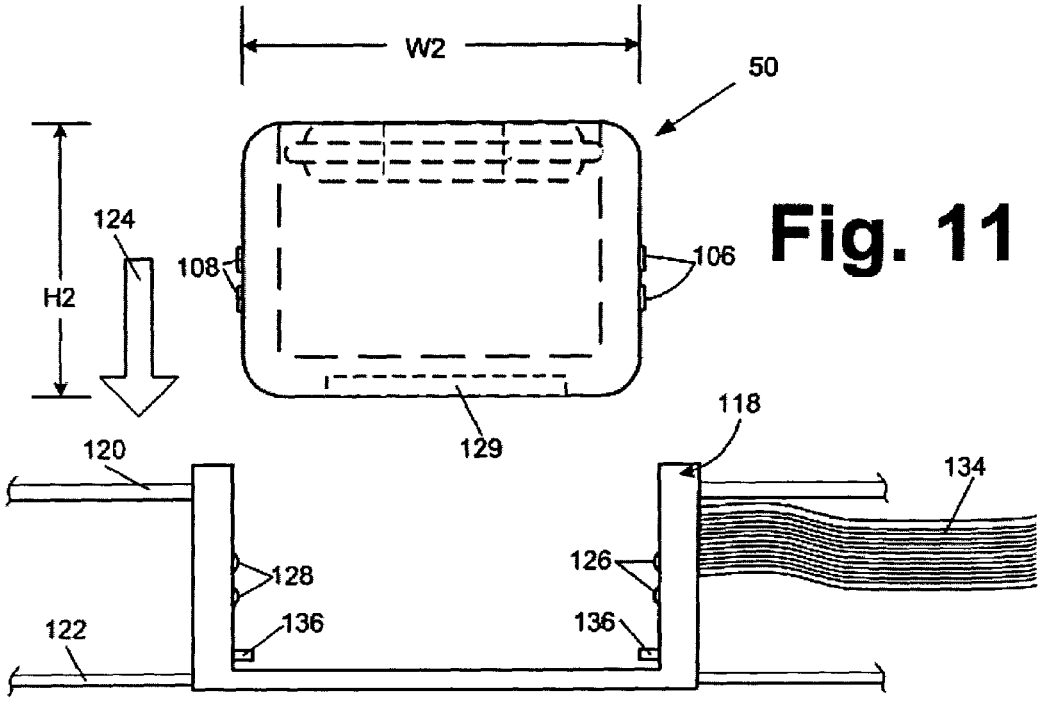
FIGS. 11 and 12 are schematic representations of inserting a low profile ink cartridge into an ink jet printer carriage according to the invention.
Figure 12:
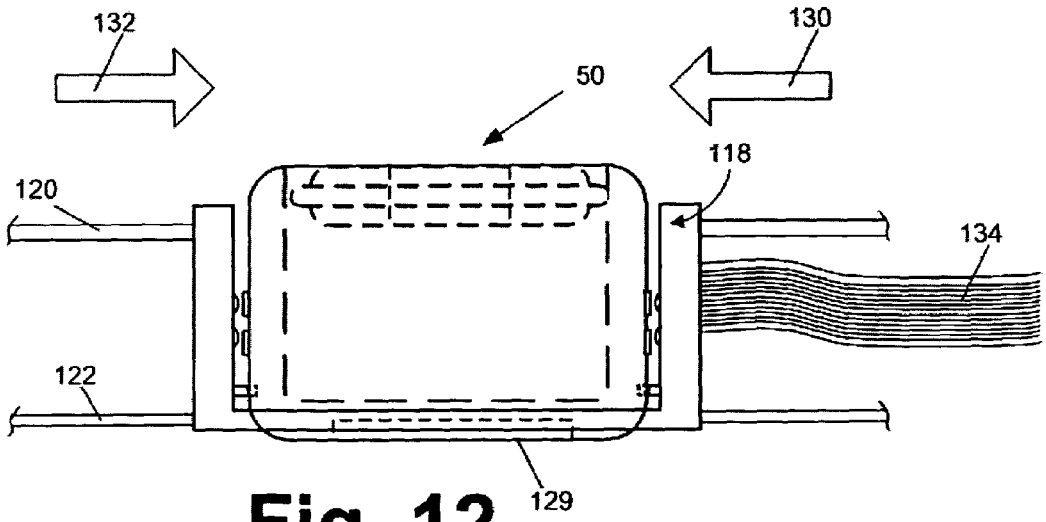

Referring now to FIGS. 11 and 12, the ink cartridge 50 is preferably inserted in a carriage 118 that is attached to guide rails, such as guide rails 120 and 122 in the printer carriage area by a substantially parallel motion relative to the carriage 118 as indicated by arrow 124. This motion is in contrast to the slanting and rotating motions required for inserting and securing the conventional ink cartridge 10 to the carriage 40 as shown in FIGS. 3 and 4.

As the ink cartridge 50 is inserted in the carriage 118, electrical contacts 126 and 128 wipe and mate with respective first and second contact pads 106 and 108 on the ink cartridge 50. The wiping movement of the contacts 126 and 128 with the contact pads 106 and 108 removes surface contaminants from the contacts and/or pads thereby improving electrical continuity between the printer and printhead 129 on the cartridge assembly 50.

It will also be appreciated that electrical contacts 126 exert a force in the direction of arrow 130 on the first contact pads 106 while electrical contacts 128 exert a substantially equal and opposite force in the direction of arrow 132 on second contact pads 108 thereby assuring electrical continuity between the printer and ink cartridge without the need for the latching device 42 as shown in FIGS. 3 and 4. A ribbon conductor cable 134 is preferably attached to the carriage 118 to provide electrical communication between the printer and the ink cartridge 50 when the ink cartridge 50 is attached to the carriage 118.

In order to assure that the electrical contacts 128 and 130 are properly aligned with the first and second contact pads 106 and 108, alignment features are preferably provided on the carriage 118 and ink cartridge 150. The alignment features include, for example, alignment tabs 136 on the carriage 118 which mate with keyhole openings 138 in the flexible circuit 100. In the alternative, the keyhole opening 138 may be provided on the carriage 118 with tabs included on the cartridge 50 for mating the keyhole openings. Other alignment features may include, but are not limited to, guide rails and guide slots, and mating machined surfaces on the cartridge 50 and carriage 118. The design described above generally and advantageously enables use of a single motion for inserting the ink cartridge 50 into the carriage 118 rather than two motions such as an insertion motion and a locking motion required by a conventional ink cartridge.

An important advantage of the invention is the provision of the first and second contact pads 106 and 108 adjacent opposing edges of the flexible circuit 100. Since more surface area of the flexible circuit 100 is available for such contact pads 106 and 108 compared to a conventional flexible circuit 26 (FIG. 1), more contacts can be provided without increasing the width (WF) or length (LF) of the flexible circuit 100. This feature enables use of less surface area of the ink cartridge body 52 for attaching the flexible circuit 100 thereto. Less cartridge body 52 surface area enables the use of cartridge bodies as described herein having the height (H2) which is less than the length (L2) thereof, i.e., a "low profile" ink cartridge assembly.

The foregoing description of certain exemplary embodiments of the present invention has been provided for purposes of illustration only, and it is understood that numerous modifications, alterations, substitutions, or changes may be made in and to the illustrated embodiments without departing from the spirit and scope of the invention.

What is claimed is:

1. A low-profile ink jet cartridge assembly for an ink jet printer, the assembly comprising:

a substantially oblong ink jet cartridge body having a printhead side, a first side surface and an opposing second side surface attached substantially orthogonal to the printhead side and having a length, a height, and a width, wherein the length is greater than the height and the width;

a printhead containing a semiconductor substrate attached to the printhead side of the ink cartridge; and a flexible circuit having a width, a length, a first edge along the length thereof, a second edge along the length thereof, first printer contact pads along at least a portion of the length thereof adjacent the first edge, and second printer contact pads along at least a portion of the length thereof adjacent the second edge, wherein the flexible circuit is electrically connected to the printhead, and wherein the portions of the flexible circuit containing the first printer contact pads are attached to the cartridge body on the first side surface and the portions of the flexible circuit containing the second printer contact pads are attached to the cartridge body on the opposing second side surface of the cartridge body.

2. The ink jet cartridge assembly of claim 1 further comprising an alignment feature on the ink cartridge assembly for aligning the printer contact pads on the flexible circuit with electrical contacts on the ink jet printer when the ink cartridge is attached to the ink jet printer.

3. The ink jet cartridge assembly of claim 2 wherein the alignment feature comprises a keyhole-shaped opening in the flexible circuit.

4. The ink jet cartridge assembly of claim 2 wherein the alignment feature comprises a keyhole-shaped opening in the cartridge body.

5. The ink jet cartridge assembly of claim 2 wherein the alignment feature comprises a key for aligning with a keyhole-shaped opening on the printer.

6. A method for increasing a number of electrical contacts to an ink cartridge without significantly increasing a height dimension of the ink cartridge comprising:

providing a substantially rectangular ink jet cartridge body having a printhead side, a first side surface and an opposing second side surface attached substantially orthogonal to the printhead side, the ink jet cartridge having a length, a height, and a width, wherein the length is greater than the height and the width;

attaching a printhead containing a semiconductor substrate to the printhead side of the ink cartridge;

providing a flexible circuit having a width, a length, a first edge along the length thereof, a second edge along the length thereof, first printer contact pads along at least a portion of the length thereof adjacent the first edge, and second printer contact pads along at least a portion of the length thereof adjacent the second edge, the first and second printer contact pads comprising a total number of electrical contacts;

connecting the flexible circuit in electrical communication with the printhead, and attaching the portions of the flexible circuit containing the first printer contact pads to the first side surface of the cartridge body and attaching the portions of the flexible circuit containing the second printer contact pads to the opposing second side surface of the cartridge body, wherein the total number of electrical contacts on the cartridge body is increased without significantly increasing the height of the cartridge body.

7. The method of claim 6 wherein the total number of electrical contact pads on the cartridge body is greater than a number of electrical contacts provided on a portion of a flexible circuit attached to only one side surface of a cartridge body.

8. The method of claim 6 further comprising providing an alignment feature on the ink cartridge body for aligning the first and second printer contact pads on the flexible circuit with electrical contacts on the ink jet printer when the ink cartridge is attached to the ink jet printer.

9. The method of claim 8 wherein the alignment feature comprises a keyhole-shaped opening in the flexible circuit.

10. The method of claim 8 wherein the alignment feature comprises a keyhole-shaped opening in the cartridge body.

11. The method of claim 8 wherein the alignment feature comprises a key for aligning with a keyhole-shaped opening on the printer.

* * * * *